United States Patent [19]

Hsu et al.

[11] Patent Number: 4,765,871

[45] **Date of Patent: * Aug. 23, 1988**

[54] ZINC-NICKEL ELECTROPLATED ARTICLE AND METHOD FOR PRODUCING THE SAME

[75] Inventors: Grace F. Hsu, Issaquah; Richard C. Colonel, Renton, both of Wash.

[73] Assignee: The Boeing Company, Seattle, Wash.

[ * ] Notice: The portion of the term of this patent subsequent to Dec. 23, 2004 has been disclaimed.

[21] Appl. No.: 628,594

[22] Filed: Jul. 6, 1984

Related U.S. Application Data

[63] Continuation-in-part of Ser. No. 348,107, Dec. 28, 1981, abandoned.

[51] Int. Cl.[4] ..... C25D 3/56

[52] U.S. Cl. ..... 204/44.2; 204/44.5; 428/658

[58] Field of Search ..... 204/44.2, 44.5, 123; 428/658, 659

[56] References Cited

U.S. PATENT DOCUMENTS

| | | | |
|---|---|---|---|
| 2,419,231 | 4/1947 | Schantz | 428/658 |
| 2,989,446 | 6/1961 | Hammond et al. | 204/41 |
| 3,064,337 | 11/1962 | Hammond et al. | 428/635 |
| 3,420,754 | 1/1969 | Roehl | 204/28 |
| 3,558,442 | 1/1971 | Roehl et al. | 204/28 |
| 3,669,854 | 6/1972 | Harbulak | 204/55 R |
| 3,691,027 | 9/1972 | Hartford | 204/29 |
| 3,723,263 | 3/1973 | Rosenberg | 204/55 R |
| 3,767,540 | 10/1973 | Rosenberg | 204/55 R |
| 3,769,182 | 10/1973 | Beckwith et al. | 204/44.4 |
| 3,785,939 | 1/1974 | Hsu | 204/44.4 |
| 3,833,486 | 9/1974 | Nobel et al. | 204/44 |
| 3,929,596 | 12/1975 | Sasame et al. | 204/49 |
| 4,070,256 | 1/1978 | Hsu et al. | 204/55 R |
| 4,075,066 | 2/1978 | Eckles et al. | 204/55 R |
| 4,135,991 | 1/1979 | Canaris et al. | 204/44.4 |
| 4,162,947 | 7/1979 | Canaris | 204/55 R |
| 4,199,417 | 4/1980 | Borruso | 204/44 |
| 4,216,272 | 8/1980 | Clauss | 428/632 |
| 4,249,999 | 2/1981 | Tsuda et al. | 204/28 |
| 4,251,329 | 2/1981 | Asano et al. | 204/27 |
| 4,251,331 | 2/1981 | Rosenberg | 204/55 R |
| 4,268,364 | 5/1981 | Hall | 204/44.2 |
| 4,282,073 | 8/1981 | Hirt et al. | 204/44.2 |
| 4,285,802 | 8/1981 | Rynne | 204/44.2 |
| 4,313,802 | 2/1982 | Shibuya et al. | 204/44.2 |
| 4,388,160 | 6/1983 | Rynne | 204/55 R |

OTHER PUBLICATIONS

Domnikov, L., Metal Finishing, pp. 49–54, Aug. 1963.

H. J. Read, Hydrogen Embrittlement in Metal Finishings, p. 16, (1961).

"Electrodeposition of Alloys", V. A. Averkin, Editor, Israel Program for Scientific Translations, pp. 102–115, (1964).

S. R. Rajagopalan, Metal Finishing, pp. 52–58, Dec. 1972.

Lustman, B., "Study of the Deposition Potentials and Microstructures of Electrodeposited Zinc-Nickel Alloys", 84th General Meeting, Trans. Electrochem. Soc., pp. 363–375, (1943).

Dini, J. W. et al., "Electrodepositing of Zinc-Nickel Alloy Coatings", Metal Finishing, pp. 31–33, (1979).

Dini, J. W. et al., Metal Finishing, pp. 53–57, Sept. 1979.

*Primary Examiner*—G. L. Kaplan

*Attorney, Agent, or Firm*—Christensen, O'Connor, Johnson & Kindness

[57] ABSTRACT

A method for producing a corrosion-resistant article exhibiting low hydrogen embrittlement, comprising electroplating the article with a zinc-nickel alloy. The zinc-nickel alloy is plated from an aqueous acidic plating solution containing zinc, nickel, an electrolyte in the form of a soluble ammonium salt, and a polyoxyalkylated nonionic surfactant. The bath can also contain an anionic surfactant, a buffer such as boric acid, and a brightener.

61 Claims, No Drawings

ZINC-NICKEL ELECTROPLATED ARTICLE AND METHOD FOR PRODUCING THE SAME

RELATED APPLICATIONS

This application is a continuation-in-part of prior copending application, Ser. No. 348,107, filed Dec. 28, 1981, and now abandoned, the filing date of which is hereby claimed pursuant to 35 U.S.C. 120.

BACKGROUND OF THE INVENTION

The present invention relates to zinc-nickel electroplated articles exhibiting corrosion resistance, including articles that, after being plated with a corrosion-resistant, zinc-nickel alloy, exhibit low hydrogen embrittlement characteristics.

High-strength steels are subject to delayed, brittle failures at relatively low stresses. Such failures have been attributed to the presence of hydrogen in the steel microstructure. The hydrogen can be introduced into the microstructure by reaction with water or with an acid, or most importantly, by cathodically discharging hydrogen at the surface of the steel. Since most high-strength steels have corrosion-resistant coatings that are applied by less than 100 percent efficient electroplating techniques, hydrogen is discharged onto the steel surface along with the corrosion-resistant coating. Therefore, the quantity of hydrogen deposited at the coating steel interface must be carefully monitored and controlled.

Currently, a cadmium-titanium alloy is electroplated onto high-strength steels under carefully controlled conditions. The resulting plated product is then heat treated at elevated temperatures to achieve an acceptable low hydrogen embrittlement level. It is believed that the porosity of the electroplated cadmium-titanium alloy is the key to the removal of the hydrogen during a subsequent heat treatment operation; however, the cadmium-titanium plating bath is very sensitive to contamination, which can cause embrittlement characteristics in coated high-strength steel substrates. More importantly, however, the cadmium-titanium alloy plating bath contains both cadmium and cyanide, which create disposal problems unless expensive waste treatment equipment is employed.

Zinc-nickel alloys have been suggested for electroplating onto steels to render them corrosion-resistant. The plating parameters of a zinc-nickel alloy plating bath are much easier to control and maintain than a cadmium-titanium bath. Additionally, the zinc-nickel bath is cadmium and cyanide free and contains components that are relatively nontoxic compared to those in a cadmium-titanium plating bath. Most prior zinc-nickel baths have, however, been suggested only for high-speed plating. High-speed plating techniques are unsatisfactory for rack plating of larger metal parts. Although it has been suggested that a zinc-nickel bath can be plated at low and medium current densities by employing an ammonium chloride electrolyte, prior attempts at plating at low current densities have led to pitted and spongy deposits that do not provide good corrosion resistance. In addition, these prior attempts to produce a zinc-nickel corrosion-resistant coating at low current densities have led to a relatively high degree of hydrogen embrittlement in plated high-strength steel parts to which the coating has been applied.

SUMMARY OF THE INVENTION

The present invention provides a method for producing a corrosion-resistant article, such as a high-strength steel, by applying a corrosion-resistant coating of a zinc-nickel alloy comprising about 80 to 94% by weight zinc, with electroplating techniques. A high-strength steel article coated in accordance with the present invention exhibits low hydrogen embrittlement characteristics. The hydrogen embrittlement of the article is maintained at a relatively low level by electroplating the zinc-nickel coating on the article in an aqueous acidic plating solution containing zinc and nickel ions, an electrolyte in the form of a soluble ammonium salt, a polyoxyalkylated nonionic surfactant. In this form of the invention, the weight ratio of nickel ions to zinc ions in the bath may range from about 0.4 to 1.0 to about 4.0 to 1.0 These zinc-nickel alloys are preferably electroplated from a bath containing: from about 3.0 to about 75.0 grams of zinc ions selected from the group consisting of zinc chloride, zinc sulfate, zine fluoborate, zinc acetate and mixtures thereof; from about 3.0 to about 75.0 grams of nickel ion selected from the group consisting of nickel chloride, nickel sulfate, nickel sulfamate, nickel fluoborate, nickel acetate, and mixtures thereof; from about 3.0 to about 100 grams of ammonium ion in the form of a soluble ammonium salt of hydrochloric acid, sulfuric acid, fluoboric acid, acetic acid, or mixtures thereof; and from about 0.5 to about 20 grams per liter of a nonionic polyoxyalkylated surfactant. It is most preferred that the bath contain at least about 15 grams of an anion selected from the group consisting of chloride, fluoborate, and mixtures thereof. In addition, acid anions selected from chloride, sulfate, fluoborate, acetate, sulfamate, and mixtures thereof are preferably present in a molar amount at least equal to the combined molar amount of zinc, nickel, and ammonium ions present in the bath. The bath can also contain a boric acid buffer, an anionic surfactant, and a brightener if desired. The bath can be effectively operated at a pH of from about 3.0 to about 7.0 and at a temperature ranging from about 15° C. to 45° C. The potential applied across the anode and the cathode workpiece is sufficient to provide current densities of about 0.05 to about 200 amperes per square decimeter at the cathode workpiece surface, although current densities from about 1.0 to about 12.0 amperes per square decimeter are preferred to produce low hydrogen embrittlement characteristics.

The presence of a nonionic surfactant is required in order to produce an article that exhibits both excellent corrosion resistance and low hydrogen embrittlement. With some sacrifice in corrosion resistance, low hydrogen embrittlement can still be achieved by operating the electroplating bath with relatively narrowly defined parameters. For example, if the nickel to zinc ion weight ratio is maintained within the range of 0.8 to 3.0:1.0, and the temperature of the bath is maintained in the range of 16° to 32° C., an article exhibiting low hydrogen embrittlement will still be produced. The corrosion resistance of this article, while being better than that of an unplated article, will not be as good as an article plated in a bath containing a nonionic surfactant.

The electroplating bath described above is free of cadmium ions, cyanides, and chelating agents. Yet the bath has a high cathode efficiency, and produces smooth adherent, ductile leveling and fine-grained, zinc-nickel alloy deposits over a wide range of plating conditions and cathode current density. Furthermore, an article plated with the zinc-nickel alloy exhibits lower hydrogen embrittlement and substantially greater corrosion resistance than an article coated with zinc or zinc-nickel alloys of the prior art. The process can also be utilized to provide zinc-nickel alloy deposits on other substrates, both metallic and nonmetallic, as long as the substrate is conductive. For example, the process can be employed to provide a zinc-nickel alloy deposit on a graphite-epoxy composite structure. Additionally, the bath is very stable, easy to control, and has a high conductivity, while requiring only simple waste treatment procedures.

DETAILED DESCRIPTION OF THE INVENTION

A zinc-nickel alloy can be electrodeposited onto a variety of electrically conductive substrates in accordance with the present invention. For example, a zinc-nickel alloy can be electrodeposited onto a graphite-epoxy article for the purpose of making that article corrosion resistant. The zinc-nickel alloy deposited in accordance with the present invention is especially efficacious, however, when applied to high-strength steel articles. Not only is the steel article rendered corrosion resistant, it also exhibits little or no hydrogen embrittlement after the electroplating process. Accordingly, the present invention provides a viable and effective substitute for prior cadmium-titanium corrosion-resistant coatings.

Prior to deposition of the zinc-nickel alloy, the article to be plated is preferably cleaned and activated for electrodeposition in accordance with the following procedure. The article to be plated is first manually solvent cleaned and vapor degreased in accordance with conventional procedures normally employed in the plating arts. After cleaning and degreasing, the article is completely dried and then cleaned with an abrasive blast. Within a relatively short period of time after the abrasive cleaning, the article is rinsed in cold water for one-half to five minutes. The part is then activated by immersing it in an acid solution for from five to 30 seconds. Within two minutes from the time the part is retrieved from the acid solution, it is rinsed with cold water for a minimum of 30 seconds up to approximately six minutes maximum. Within two minutes after the completion of the cold water rinse, the part can be immersed in the zinc-nickel plating bath as described below.

The plating bath formed in accordance with the present invention is an aqueous solution containing zinc, nickel and an electrolyte in the form of a soluble ammonium salt, along with a nonionic polyoxyalkylated surfactant. The cations are placed in an aqueous solution of a solubilized oxide or salt of the cation. It is preferred, as will be discussed in more detail below, that the solution contain acid anions, and that at least a portion of the acid anions comprise chloride or fluoborate. The addition of a buffer such as boric acid, an anionic surfactant, and brighteners are optional, but preferred for the commercial plating embodiment of the present invention.

The zinc cations can be provided by a variety of water-soluble zinc compounds. These compounds can include zinc oxide, which is capable of forming a zinc salt in the presence of acid anions, such as chloride ions that are normally present in an aqueous bath prepared in accordance with the present invention. The water-soluble compounds also include zinc salts such as zinc chloride, zinc sulfate, zinc fluoborate, zinc acetate and, of course, the various combinations and mixtures thereof. Concentration of the zinc salt should be sufficient to provide from about 3.0 to about 75.0 grams of zinc ion per liter of solution. Preferably, the zinc ions should be present in an amount ranging from 6.0 to 30.0 grams per liter of solution, more preferably from 6.0 to 15.0 grams per liter and most preferably from 7.5 to 10.5 grams per liter.

The nickel salts can be provided from a variety of water-soluble nickel salts, including nickel chloride, nickel sulfate, nickel sulfamate, nickel fluoborate, nickel acetate, and the various mixtures and combinations thereof. The nickel salt should be present in an amount sufficient to provide from about 3.0 to about 75.0 grams of nickel ion per liter of solution. It is preferred that about 3.0 to about 30.0 grams of nickel ion, more preferably 10 to 25 grams, and most preferably 16.5 to 21 grams per liter of solution be employed. The nickel ion to zinc ion weight ratio can be varied, for example from about 0.4:1 to about 4:1, while still obtaining a satisfactory coating. At low nickel/zinc ratios, hydrogen embrittlement is minimized. At low ratios, hydrogen reembrittlement tends to be aggravated. The opposite is true at high nickel/zinc ratios for both hydrogen embrittlement and reembrittlement. For a plated coating exhibiting optimum corrosion resistance and low hydrogen embrittlement and reembrittlement characteristics, it is preferred that the weight ratio of nickel ion to zinc ion be in the range of from 1.5 to 2.7 and most preferably in the range of from 1.7 to 2.3.

The conductivity of the electroplating bath is increased by the presence of the electrolyte. The preferred electrolytes include soluble ammonium salts of hydrochloric acid, sulfuric acid, fluoboric acid, acetic acid, and the various mixtures and combinations thereof. The ammonium salt should be present in the bath in an amount sufficient to provide from about 3.0 to about 100 grams of ammonium ion per liter of solution, preferably from 50 to 90 grams per liter, more preferably from 40 to 70 grams per liter and most preferably from about 50 to about 60 grams per liter of solution. These ranges for ammonium ion addition are exclusive of any ammonium hydroxide added for pH adjustment. While any of the aforementioned ammonium salts can be employed as the electrolyte, it is most preferred that either ammonium chloride or ammonium fluoborate be employed as the salt from which the ammonium ion is derived. These salts provide relatively uniform plating results over a wider range of current densities.

It is also preferred that the bath contain acid anions in the form of chloride or fluoborate anions or mixtures thereof in amounts ranging from 15 to 200 grams per liter of solution. It is also preferred that the acid anions, including chloride, sulfate, fluoborate, acetate, sulfamate and mixtures thereof be present in a molar amount at least equal to the combined molar amount of zinc, nickel and ammonium present in the solution. It is more preferred that the acid anions be present in the range of from about 120 to 150 grams per liter of solution while 128 to 146 grams of acid anions per liter of solution are most preferred. Of the acid anions, the chloride anion is most preferred. Consequently, the most preferred bath is one composed primarily of zinc chloride, nickel chloride, and ammonium chloride. It is most preferred that the bath contain at least about 15.0 grams per liter of chloride or fluoborate ions.

The presence of a nonionic polyoxyalkylated surfactant in the zinc-nickel plating bath is critical to producing a corrosion-resistant, coated high-strength steel that has low hydrogen embrittlement. The presence of the nonionic polyoxyalkylated surfactant produces a zinc-nickel coating that is smooth, adherent, ductile, leveling, and fine-grained, over a wide range of plating conditions and cathode current densities. A wide variety of surface-active polyoxyalkylated compounds can be employed in accordance with the present invention as long as they are soluble in the aqueous bath. The following are representative examples of broad classes of compounds that can be employed in accordance with the present invention: alkoxylated alkyl phenols, alkoxylated alkyl naphthols, alkoxylated aliphatic monohydric alcohols, alkoxylated polyoxypropylene glycols, alkoxylated 2,4,7,9-tetramethyl-5-decyne-4,7-diol, alkoxylated ethylene diamine, alkoxylated fatty acids, alkoxylated amides and alkoxylated esters. The polyethoxylated alkyl phenols, however, have been found to be particularly effective in producing corrosion-resistant coated substrates having a low hydrogen embrittlement in accordance with the present invention. Particular polyethoxylated alkyl phenol surfactants that are commercially available include ethoxylated nonyl phenol sold under the trade name "Tergitol NP-15" by Union Carbide Corporation and under the trade name "Igepal CO-730" by GAF Corporation. The latter surfactant contains approximately 15 repeating ethyleneoxy units in the hydrophilic portion of the molecule. Other suitable nonionic surfactants include "Igepal CO-887" from GAF Corporation and "Nentronyx 656" from Millmaster Onyx Corporation. It is preferred that the nonionic surfactant be present in the bath in accordance with the present invention in an amount ranging from about 0.5 to about 20.0 grams per liter of solution, more preferably from about 1.0 to about 5.0 grams per liter and most preferably from about 1.8 to 3.4 grams per liter.

Although the presence of the nonionic polyoxyalkylated surfactant in combination with the zinc, nickel and ammonium cations, and chloride and/or fluoborate anions are required to produce a corrosion-resistant coated high-strength steel substrate that exhibits both low hydrogen embrittlement and reembrittlement in accordance with the present invention, other materials can be added to enhance desirable characteristics in the plating process as well as in the final product. For example, boric acid may be advantageously included in the bath to function as a buffer. Boric acid can be present in the range of from about 1.0 gram per liter of solution up to saturation of boric acid in the bath, and most preferably in the range of 18 to 22 grams per liter.

An anionic surfactant is preferably added to the bath to increase the high end of the cathode current density range and to further improve the low hydrogen embrittlement characteristics of the final product. Although anionic surfactants in general tend to be insoluble in plating baths, the nonionic polyoxyalkylated surfactants function as a solubilizer for the anionic surfactants. Numerous anionic surfactants can be employed in accordance with the present invention. However, the alcohol sulfates and the alkyl aryl sulfonates are found to be particularly successful. A suitable alcohol sulfate includes the sodium lauryl sulfate commercially available from E. I. duPont de Nemours and Company, Inc. under the trade name "Duponol ME Dry". A suitable alkyl aryl sulfonate is the sodium dodecylbenzene sulfonate available from Stepan Chemical Company under the trade name "Nacconol 90F". The anionic surfactant can be present in the bath in amounts ranging from about 0.2 to about 7.5 grams per liter of solution, although from 0.4 to 2.0 grams per liter of the anionic surfactant are preferred and 0.6 to 1.2 grams per liter most preferred. It is also to be noted that the foregoing list of anionic surfactants is not intended to be exclusive. Other anionic surfactants that are soluble in the system otherwise formulated in accordance with the present invention and that do not detract from the superior results obtained by the present invention can be employed.

Organic brighteners can also be employed to provide bright, specular deposits over the useful cathode current density ranges, that is, from about 0.3 to about 4.5 amperes per square decimeter. Suitable organic brighteners include the ring-halogenated aryl aldehydes and aryl olefinic ketones. Examples of the ring-halogenated aryl aldehydes include ortho-chlorobenzaldehyde, para-chlorobenzaldehyde, 2,4-dichlorobenzaldehyde, and 2,6-dichlorobenzaldehyde. An example of a suitable aryl olefinic ketone is benzylidene acetone. Other known organic brighteners such as aryl ketones, aryl aldehydes, ring-halogenated aryl ketones, heterocyclic ketones and aldehydes, as well as aryl olefinic aldehydes can be employed. The most preferred brighteners are ortho-chlorobenzaldehyde and benzylidene acetone. These brighteners can be employed in the bath in amounts ranging from about 0.02 to about 2.0 grams per liter of solution. The most preferred range includes the brighteners in amounts ranging from about 0.05 to about 1.0 gram per liter of solution.

The zinc-nickel plating process can be carried out in the generally conventional pH, temperature, and current density ranges. When carried out with a preferred solution as outlined above and within the preferred operating ranges set forth herein, an alloy containing from 80 to 94 percent by weight zinc with the balance (6 to 20 percent) being nickel is produced. This coating will provide excellent corrosion resistance as well as sufficient porosity to allow hydrogen embrittlement to be achieved. It is most preferred that the coating consist of 86 to 88 weight percent zinc and from 12 to 14 weight percent nickel. Within these narrow ranges, optimum corrosion resistance and hydrogen embrittlement and reembrittlement characteristics are realized. If the composition of the coating deviates from the broad composition ranges set forth, the desired characteristics deteriorate.

The bath can effectively be operated in a pH range of from about 3.0 to about 7.0, preferably from about 5.5 to about 6.5, more preferably from 6.0 to 6.6 and most preferably from 6.2 to 6.45. It is preferred that the pH of the bath be adjusted by the addition of ammonium hydroxide or hydrochloric acid as the need may be, so as to avoid the introduction of undesirable ions into the solution. The zinc-nickel alloy can be plated in accordance with the present invention over a wide variety of temperatures and current densities. The electrodeposition can occur over a broad temperature range of from about 15° C. to about 45° C., preferably of from about 16° C. to about 32° C., and most preferably from 18° C. to 29° C. The cathode current densities can range from about 0.05 to about 200 amperes per square decimeter and still yield a satisfactory corrosion-resistant coating. However, to also achieve low hydrogen embrittlement, current densities in the range of from 1.0 to 12.0 amperes per square decimeter are preferred, while current densities in the range of from 1.0 to 4.5 A/d$^2$ are more preferred and 2.0 to 3.5 A/d$^2$ are most preferred.

Although not necessary, a chromate or phosphate treatment of the part can follow the zinc-nickel plating step. In any event, within eight hours of completion of the plating step, the part is baked to relieve hydrogen embrittlement. Most steels except carburized steel and 440 steels can be baked at temperatures on the order of 350° F. to 400° F. for a minimum of 12 hours. Carburized steels and 440 steels, however, should be baked at a lower temperature of from 250° F. to 300° F. for only five to eight hours. If desired, the part can be chromate or phosphate treated subsequent to the hydrogen embrittlement bake.

Table I summarizes the alloy ranges, bath composition and operating parameters set forth above.

TABLE I

| | Broad | Preferred | More Preferred | Most Preferred |
|---|---|---|---|---|
| I. Alloy Composition (wt. %) | | | | |
| Zn | 80–94% | — | — | 86–88% |
| Ni | 6–20% | — | — | 12–14% |
| II. Bath Composition* | | | | |
| Zn | 3.0–75.0 | 6.0–30.0 | 6.0–15.0 | 7.5–10.5 |
| Ni | 3.0–75.0 | 3.0–30.0 | 10–25 | 16.5–21 |
| Ni/Zn Ratio | 0.4–4.0 | 0.8–3.0 | 1.5–2.7 | 1.7–2.3 |
| Acid Anion (Cl) | 15–200 | 120–200 | 120–150 | 128–146 |
| Boric Acid | 1.0–Saturation | — | 15–25 | 18–22 |
| Non-Ionic Surfactant | 0.5–20 | — | 1.0–5.0 | 1.8–3.4 |
| Anionic Surfactant | 0.2–7.5 | — | 0.4–2.0 | 0.6–1.2 |
| $NH_4$ | 3.0–100 | 50–90 | 40–70 | 50–60 |
| III. Operating Conditions | | | | |
| pH | 3.0–7.0 | 5.5–6.5 | 6.0–6.6 | 6.2–6.45 |
| Temp.(°C.) | 15–45 | — | 16–32 | 18–29 |
| Current Density (A/dm$^2$) | 0.05–200 | 1.0–12.0 | 1.0–4.5 | 2.0–3.5 |

*All compositions are in grams per liter of solution. The Ni/Zn ratio is a weight ratio.

If the nonionic polyoxyalkylated surfactant is omitted from the plating solution, but the other operational parameters of the present invention are maintained within ranges defined below, a zinc-nickel coating exhibiting excellent low hydrogen embrittlement and reembrittlement characteristics is still surprisingly achieved. The corrosion resistance of the coating is not, however, as good as when the nonionic surfactant is present in the plating solution. In order to achieve this surprising result, the alloy coating bath composition and electroplating operating conditions must be maintained within the ranges set forth in Table II below. The addition of surfactants and brighteners are optional.

TABLE II

| | Preferred | Most Preferred |
|---|---|---|
| I. Alloy Composition (wt. %) | | |
| Zn | 80–94% | 86–88% |
| Ni | 20–6% | 14–12% |
| II. Bath Composition** | | |
| Zn | 6–25 | 7.5–10.5 |
| Ni | 6–25 | 16.5–21 |
| Ni/Zn Ratio | 0.8–3.0 | 1.7–2.3 |
| Acid Anion | 120–150 | 128–146 |
| $NH_4$*** | 40–70 | 50–60 |

TABLE II-continued

| | Preferred | Most Preferred |
|---|---|---|
| Boric Acid | 10–Saturation | 18–22 |
| III. Operating Conditions | | |
| pH | 6.0–6.6 | 6.20–6.45 |
| Temp. (°C.) | 16–32 | 18–29 |
| Current Density (A/dm$^2$) | 1.0–4.5 | 2.0–3.5 |

**All compositions are in grams per liter of solution. The Ni/Zn ratio is a weight ratio.

***These amounts do not include ammonium ions placed in the solution for purposes of pH adjustment.

EXAMPLES

The following examples are included to assist one of ordinary skill in making and using the invention. They are intended as representative examples of the present invention and are not intended in any way to limit the scope of this disclosure or the scope of protection granted by Letters Patent hereon. All parts and percentages referred to in the following examples are by weight unless otherwise indicated. Additionally, when the Hull cell is mentioned, testing was undertaken utilizing a conventional 267 ml Hull cell employing three amperes of current for three minutes. The bath was not agitated. The pH adjustments were made as necessary by utilizing appropriate acids or ammonium hydroxide.

EXAMPLE I

An aqueous electroplating bath containing no surfactant was prepared containing per liter of solution, 15 grams of zinc oxide, 47.5 grams of nickel chloride ($NiCl_2.6H_2O$), 250 grams of ammonium chloride and 20 grams of boric acid. The pH of the bath was 5.7 and was maintained at a temperature of 40° C. Only zinc was employed as an anode. A Hull cell panel was prepared with current densities up to 8.0 amperes per square decimeter. At a current density up to 1.5 amperes per square decimeter, the zinc-nickel alloy deposit was semibright with a blue tint, indicating a satisfactory deposit. At current densities ranging from 1.5 to 4.0 amperes per square decimeter, the deposit was pitted. The pitting, of course, is an undesirable characteristic in a corrosion-resistant coating. At current densities from 4.0 to 8.0 amperes per square decimeter the deposit was grey, indicating a satisfactory deposit. However, above eight amperes per square decimeter, the deposit was dark grey and slightly spongy. Spongy deposits are undesirable.

EXAMPLE II

The procedure of Example I was repeated, with the exception that 0.375 gram per liter of solution of an anionic surfactant, "Duponol ME Dry", was added. The temperature of the bath was about 31° C. The bath was cloudy. A Hull cell panel was prepared. The panel generally appeared blotchy. At a current density up to 0.7 amperes per square decimeter, the zinc-nickel alloy deposit was cloudy. At a current density of from 0.7 to 2.0 amperes per square decimeter, the deposit was bright; however, the deposit was pitted at a current density above 1.5 amperes per square decimeter. At current densities ranging from 2.0 to 9.0 amperes per square decimeter, the deposit was cloudy. Above 9.0 amperes per square decimeter, the deposit was a blue-black.

EXAMPLE III

The procedure of Example II was again repeated, but this time adding 3.0 grams per liter of "Tergitol NP-15", a nonionic surfactant, to the plating bath. A Hull cell panel was prepared. There was no blotchy deposit on the panel. At a current density up to 6.0 amperes per square decimeter, the zinc-nickel alloy deposit was bluish bright. At current densities ranging from 6.0 to 12.0 amperes per square decimeter, the deposit was grey. Above 12.0 amperes per square decimeter, a blue-black deposit was obtained. No spongy deposit was noted. Both the coverage of the plating bath and the throwing power of the plating were better in the presence of the nonionic surfactant when compared with the baths of both Example I and Example II.

EXAMPLE IV

An aqueous electroplating bath was prepared containing per liter of solution: 47 grams of zinc chloride; 61 grams of nickel chloride; 250 grams of ammonium chloride; 20 grams of boric acid. The weight ratio of nickel to zinc ions is about 0.67. The pH of the bath was adjusted to 5.9 by the addition of ammonium hydroxide. The temperature of the bath was 24° C. Notched tensile specimens (NTS) manufactured and tested in accordance with ASTM F-519, Type Ia, were plated in the bath. Two nickel and two zinc rods having similar area were used as anodes and arranged symmetrically about the specimens. The specimens were plated at preselected current densities for preselected times. After plating, the specimens were baked for 12 hours at 190° C. The specimens were then tested by static tensile loading at 75 percent of established notch ultimate tensile strength (dry test). The specimens were loaded continuously for at least 150 hours or until failure. The specimens that withstand the loading for more than 150 hours exhibit satisfactory low hydrogen embrittlement characteristics.

Two specimens were plated at an average cathode current density of 1.0 ampere per square decimeter for 30 minutes. One specimen failed the static tensile test 12.7 hours after loading. The other specimen passed the loading test and was removed from the test device after 167 hours. Another specimen was plated at 2.0 amperes per square decimeter for 15 minutes. This specimen also passed the loading test and was removed from the test apparatus after 167 hours; however, a fourth specimen plated at two amperes per square decimeter for 30 minutes failed 36.5 hours after loading. The plated deposit for specimens coated at both 1.0 and 2.0 amperes per square decimeter was found to contain about 85 percent zinc and 15 percent by weight nickel. The deposit did not exhibit satisfactory low hydrogen embrittlement (LHE) characteristics.

EXAMPLE V

An aqueous electroplating bath was prepared containing per liter of solution: 17.8 grams of zinc oxide; 35.6 ml of hydrochloric acid (38 percent by weight HCl); 24 grams of nickel chloride; 220 grams of ammonium chloride; 20 grams of boric acid; approximately 8 ml of ammonium hydroxide (29 percent by weight $NH_3$). The pH of the bath was 6.2. The weight ratio of nickel to zinc ions in the solution is about 0.4. The temperature of the bath was 24° C. Notched tensile specimens were prepared in accordance with the standards set forth in the previous Example. Three specimens were plated at 1.5 amperes per square decimeter for 20 minutes and three specimens were plated at 3.0 amperes per square decimeter for ten minutes. The zinc-nickel deposited on the specimens was dull with heavy pitting. All of the specimens were tested by loading them in accordance with the procedure set forth in Example IV, with the exception that the specimens were loaded for 200 hours. All specimens passed the 200-hour loading test (dry test).

EXAMPLE VI

The procedure of Example V was repeated with the exception that the pH of the bath was adjusted to 5.8 and 2.25 grams per liter of solution of a nonionic polyoxyalkylated surfactant ("Tergitol NP-15") were added. Five notched tensile specimens were plated at 3.0 amperes per square decimeter for 7.5 minutes. The deposit was satisfactory. The fractured cross-section had a grainy look when viewed under magnification. All specimens passed the 200-hour loading test.

EXAMPLE VII

The procedure of Example VI was repeated with the exception that 0.75 gram per liter of an anionic surfactant ("Duponol ME Dry") was also added to the bath. Three notched tensile specimens were plated at 3.0 amperes per square decimeter for 7.5 minutes. When viewed under magnification, an improvement in the ductile nature of the deposits was observed. All specimens passed a 200-hour loading test.

EXAMPLE VIII

The procedure of Example VII was repeated with the exception that the pH of the bath was adjusted to 6.2 by the addition of ammonium hydroxide. Two notched tensile specimens were plated at 3.0 amperes per square decimeter for 7.5 minutes. The ductile appearance of the deposits was observed under magnification. All specimens passed the 200-hour loading test.

EXAMPLE IX

An aqueous electroplating bath was prepared containing per liter of solution: 50 grams of zinc oxide; 100 ml of hydrochloric acid; 167 grams of nickel chloride; 90 grams of ammonium chloride; 20 grams of boric acid; approximately 75 ml of ammonium hydroxide. The pH of the bath was 5.9. The temperature of the bath was about 28° C. A copper wire was plated at a current density of approximately 100 amperes per square decimeter for approximately 20 seconds at a linear speed of 98 feet per minute. The deposit was dark grey and grainy. Another copper wire was plated at the same condition as before, with the exception that 2.25 grams per liter of solution of a nonionic polyoxyalkylated surfactant ("Igepal CO-730") and 0.75 grams per liter of an anionic surfactant ("Duponol ME Dry") were also added to the bath. Now the deposit was light grey and fine grained.

EXAMPLE X

The procedure of Example IV was repeated with the exception that 220 grams per liter of ammonium chloride was used, pH of the bath was 5.8 and distilled water was used. Three notched tensile specimens were plated at 2.0 ampere per square decimeter for 30 minutes and all specimens passed 200 hours loading test. Two notched tensile specimens were plated at 1.0 ampere per square decimeter for 30 minutes and all specimens passed 200 hours dry loading test. Reducing the chloride content in the solution improves the LHE characteristics.

EXAMPLE XI

The procedure of Example V was repeated with the exception that 2.25 grams per liter of solution of a nonionic polyoxyalkylated surfactant ("Igepal CO-730"), and 0.75 gram per liter of an anionic surfactant ("Duponol ME Dry") were also added to the bath. Four NTS specimens were plated at 2.0 ampere per square decimeter for 18 minutes. Two specimens passed the 200-hour dry loading test. Two other specimens were tested by static tensile loading at 45 percent of established notch ultimate tensile strength while the notch was exposed to distilled water (wet test). The specimens were loaded continuously for at least 150 hours or until failure. The specimens that withstand loading for at least 150 hours exhibit satisfactory low hydrogen reembrittlement characteristics. One specimen failed in 6 minutes while the other specimen failed after 4 hours of loading. The deposit exhibits satisfactory LHE characteristics, but unsatisfactory low hydrogen reembrittlement characteristics. No corrosion product was observed on the specimens after the wet test.

EXAMPLE XII

An aqueous electroplating bath was prepared containing per liter of solution: 15 grams of zinc oxide; 30 ml of hydrochloric acid (38 percent by weight HCl); 49 grams of nickel chloride ($NiCl_2.6H_2O$); 180 grams of ammonium chloride; 20 grams of boric acid.

The pH of the bath was adjusted to 6.3 by the addition of ammonium hydroxide. The ratio of nickel ions to zinc ions in said solution is 1.0. The temperature of the bath was 24° C.

Four NTS specimens were plated at 2.0 ampere per square decimeter for 18 minutes. Two specimens passed the 200-hours dry loading test. Two other specimens were scratched in the notch area by scribing the notch four strokes with a sharp instrument to expose bare steel. Then, the specimens were immersed in distilled water and loaded to 45 percent of ultimate tensile strength continuously for at least 150 hours or until failure (wet and scratch test). The specimens that withstand loading for at least 150 hours exhibit satisfactory low hydrogen reembrittlement and damage tolerance characteristics. Both specimens passed the 150-hour wet and scratch loading test. After the wet and scratch test, white corrosion was observed on the specimen on the immersed area.

EXAMPLE XIII

The procedure of Example XII was repeated with the exception that 2.25 grams per liter of solution of a nonionic polyoxyalkylated surfactant ("Igepal CO-730"), and 0.75 gram per liter of an anionic surfactant ("Duponol ME Dry") were also added to the bath. Six NTS specimens were plated at 2.0 $A/dm^2$ for 18 minutes. Two specimens passed the 200-hour dry loading test. Two specimens passed the 150-hour wet loading test. Two specimens failed the 150-hour wet and scratch loading test. The deposit did not provide satisfactory damage tolerance characteristics. No corrosion product was observed on the specimens after the wet or wet and scratch test.

EXAMPLE XIV

An aqueous electroplating bath was prepared containing per liter of soltuion: 11.2 grams of zinc oxide; 22.4 ml of hydrochloric acid (38 percent by weight HCl); 73.3 grams of nickel chloride ($NiCl_2.6H_2O$); 170 grams of ammonium chloride; 20 grams of boric acid; 2.25 grams of nonionic polyoxyalkylated surfactant ("Igepal CO-730") and 0.75 grams of an anionic surfactant ("Duponol ME Dry"). The pH of the bath was adjusted to 6.3 by the addition of ammonium hydroxide. The ratio of nickel ions to zinc ions in said solutin is 2.0. The temperature of the bath was 24° C.

Six NTS specimens were plated at 2.0 ampere per square decimeter for 18 minutes. Two specimens each passed the dry, wet, and wet and scratch loading tests. The deposit exhibits satisfactory LHE, low hydrogen reembrittlement and damage tolerance characteristics. Again, while the surfactants were present in the solution, no corrosion product was observed in the specimens after wet or wet and scratch test. The presence of surfactants in the solution improves the plating deposit properties, such as LHE, corrosion resistance, grain refinement, throwing power, leveling, coverage and pitting, etc.

EXAMPLE XV

An aqueous electroplating bath was prepared containing per liter of solution: 11.2 grams of zinc oxide; 22.4 ml of hydrochloric acid (38 percent by weight HCl); 84 grams of nickel chloride ($NiCl_2.6H_2O$); 165 grams of ammonium chloride and 20 grams of boric acid. The pH of the bath was adjusted to 6.3 by the addition of ammonium hydroxide. The weight ratio of nickel ions to zinc ions in said solution is 2.3. The temperature of the bath was 24° C.

Two NTS specimens were plated at 2.0 ampere per square decimeter for 18 minutes. Two specimens passed the dry test. One of the specimens, after passing the dry test, passed the wet and scratch test too. After the wet and scratch test, red dust was observed around the scribed area and some white corrosion was observed in the notch area.

Table II illustrates the results of the NTS tests conducted in accordance with Examples IV, V and X through XV.

TABLE II

| Example | Ni/Zn Ratio | Surfactants | NTS Test Dry | Wet | Wet and Scratch |
|---|---|---|---|---|---|
| IV | 0.67 | No (high chloride, low pH) | Failed | | |
| X | 0.67 | No (lower chloride than Example 1) | Passed | | |
| V | 0.4 | No | Passed | | |
| XI | 0.4 | Yes | Passed | Failed | |
| XII | 1.0 | No | Passed | | Passed |
| XIII | 1.0 | Yes | Passed | Passed | Failed |
| XIV | 2.0 | Yes | Passed | Passed | Passed |
| XV | 2.3 | No | Passed | | Passed |

CONCLUSION

In summary, the zinc-nickel coating plated in accordance with the present invention not only provides excellent corrosion resistance to steel articles but also yields an end product that, when baked, has very low hydrogen embrittlement characteristics. The key to producing such a product in accordance with the present invention is the presence of the nonionic polyoxyalkylated surfactant. However, if some degree of corrosion resistance can be sacrificed, a coated article exhibiting low hydrogen embrittlement can still be obtained in the absence of the nonionic surfactant, provided the electroplating parameters are maintained within the ranges specified above.

Although the primary use of the present invention is currently producing a corrosion-resistant coating on steel parts that results in low hydrogen embrittlement of the steel, the invention can also be employed to plate metal strips and wires, as well as other articles. Electroplating of steel parts to produce a product exhibiting low hydrogen embrittlement is generally performed at relatively low current densities. It is, however, generally desirable to plate metal strips and wires at high current densities while still producing a good corrosion-resistant coating. For example, a plating solution containing an ammonium chloride electrolyte and a nonionic surfactant can be employed to plate at current densities up to about 200 amperes per square decimeter. At such high current densities, it is preferable to agitate the solution during plating and also to increase the zinc and nickel content in the solution over that normally used at low current densities.

The present invention has been described in relation to a preferred embodiment thereof and several alternatives thereto. One of ordinary skill, after reading the foregoing specification, will be able to effect various changes, substitutions of equivalents and other alterations without departing from the broad concepts disclosed herein. It is therefore intended that the scope of Letters Patent granted hereon be limited only by the definition contained in the appended claims and equivalents thereof.

The embodiments of the invention in which an exclusive property or privilege is claimed are defined as follows:

1. A method for producing a corrosion-resistant article, said article being conductive, said method comprising:

electroplating a zinc-nickel coating on said article in an aqueous, acidic plating solution containing zinc and nickel ions, an electrolyte in the form of a soluble ammonium salt, and a polyoxyalkylated nonionic surfactant, the weight ratio of nickel ions to zinc ions in said solution being in the range of from about 0.4 to 1.0 to about 4.0 to 1.0, said coating comprising from about 80% to about 94% by weight zinc, the balance being nickel.

2. The method of claim 1 wherein said article comprises high-strength steel, said article when coated being characterized by low hydrogen embrittlement.

3. The method of claim 2 wherein said article is plated at a current density of from about 1.0 to about 12.0 amperes per square decimeter.

4. The method of claim 1 wherein said zinc ion is present in the form of zinc oxide, zinc chloride, zinc sulfate, zinc fluoborate, zinc acetate or mixtures thereof; wherein said nickel is present in the form of nickel chloride, nickel sulfate, nickel sulfamate, nickel fluoborate, nickel acetate or mixtures thereof; and wherein said electrolyte is present in the form of a soluble salt of hydrochloric acid, sulfuric acid, fluoboric acid, acetic acid or mixtures thereof.

5. The method of claim 4 wherein at least about 15 grams per liter of anion selected from chloride, fluoborate or mixtures thereof are present in said solution.

6. The method of claim 5 wherein said acid anion consists essentially of chloride ion.

7. The method of claim 5 wherein the acid anions selected from the group consisting of chloride, sulfate, fluoborate, acetate, sulfamate and mixtures thereof are present in molar proportions at least equal to the combined zinc, nickel and ammonium ions present in said solution.

8. The method of claim 7 wherein said nonionic, polyoxyalkylated surfactant is selected from the group consisting of alkoxylated alkyl phenols, alkoxylated alkyl naphthols, alkoxylated aliphatic monohydric alcohols, alkoxylated polyoxypropylene glycols, alkoxylated 2,4,7,9-tetramethyl-5-decyne-4,7-diol, alkoxylated ethylene diamine, alkoxylated fatty acids, alkoxylated amides and alkoxylated esters.

9. The method of claim 8 wherein said bath further contains boric acid in an amount ranging from about 1.0 grams per liter of solution to saturation in said solution.

10. The method of claim 9 wherein said acid anion consists essentially of chloride ion.

11. The method of claim 8 wherein said bath further contains an anionic surfactant in an amount ranging from about 0.2 to about 7.5 grams per liter of solution.

12. The method of claim 11 wherein said anionic surfactant comprises an alcohol sulfate, an alkyl aryl sulfonate, or mixtures thereof.

13. The method of claim 11 wherein said anionic surfactant is present in an amount ranging from about 0.4 to about 7.5 grams per liter of solution.

14. The method of claim 11 wherein said acid anion consists essentially of chloride ion.

15. The method of claim 8 wherein said bath further contains a brightener in an amount ranging from about 0.02 to about 2.0 grams per liter of solution.

16. The method of claim 15 wherein said acid anion consists essentially of chloride ion.

17. The method of claim 8 wherein said nonionic surfactant comprises a polyethoxylated alkyl phenol.

18. The method of claim 8 wherein said bath is maintained at a pH in the range of from about 3.0 to about 7.0.

19. The method of claim 18 wherein said pH is maintained in the range of from about 5.5 to about 6.5.

20. The method of claim 18 wherein the temperature of said bath is maintained in the range of from about 15° C. to about 45° C.

21. The method of claim 20 wherein said temperature is maintained in the range of from about 20° C. to about 32° C.

22. The method of claim 20 wherein said article is the cathode, and an anode is immersed in said solution, the voltage applied between said cathode and anode being sufficient to provide a current density in the range of from 0.05 amperes per square decimeter to about 200 amperes per square decimeter.

23. The method of claim 22 wherein said zinc ion is present in an amount ranging from about 3.0 to about 75.0 grams per liter of solution.

24. The method of claim 23 wherein said nickel ion is present in an amount ranging from about 3.0 to about 75.0 grams per liter of solution.

25. The method of claim 24 wherein said ammonium ion is present in an amount ranging from about 3.0 to about 100 grams per liter of solution.

26. The method of claim 25 wherein said acid anions are present in a molar amount at least equal to the combined molar amount of nickel, zinc and ammonium ions, the sum total of said acid anions being present in said solution in the range of from about 15.0 to about 200 grams per liter.

27. The method of claim 26 wherein said nonionic surfactant is present in an amount ranging from about 0.5 to about 20.0 grams per liter of solution.

28. The method of claim 27 wherein said zinc ion is present in an amount ranging from about 6.0 to about 30.0 grams per liter of solution.

29. The method of claim 28 wherein said nickel ion is present in an amount ranging from about 3.0 to about 30.0 grams per liter of solution.

30. The method of claim 29 wherein said ammonium ion is present in an amount ranging from about 50 to about 90 grams per liter of solution.

31. The method of claim 30 wherein said acid anions are present in said solution in an amount ranging from about 120 to about 150 grams per liter of solution.

32. The method of claim 31 wherein said nonionic surfactant is present in an amount ranging from about 1.0 to about 5.0 grams per liter of solution.

33. The method of claim 32 wherein the weight ratio of nickel ion to zinc ion in said solution is from about 1.7 to 1 to about 2.3 to 1.

34. An article produced by the method of claim 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, or 33.

35. An electroplating bath for producing a coated article exhibitng corrosion resistance and low hydrogen embrittlement, said article being conductive, said bath comprising:

an aqueous, acidic solution containing zinc and nickel ions, an electrolyte in the form of a soluble ammonium salt, and a polyoxyalkylated nonionic surfactant, the weight ratio of nickel ions to zinc ions in said solution being in the range of from about 0.4 to 1.0 to about 4.0 to 1.0.

36. The bath of claim 35 wherein said zinc ion is present in the form of zinc oxide, zinc chloride, zinc sulfate, zinc fluoborate, zinc acetate or mixtures thereof; wherein said nickel is present in the form of nickel chloride, nickel sulfate, nickel sulfamate, nickel fluoborate, nickel acetate or mixtures thereof; and wherein said electrolyte is present in the form of a soluble salt of hydrochloric acid, sulfuric acid, fluoboric acid, acetic acid or mixtures thereof.

37. The bath of claim 36 wherein at least about 15 grams per liter of anion selected from chloride, or mixtures thereof are present in said solution.

38. The bath of claim 37 wherein said acid anion consists essentially of chloride ion.

39. The bath of claim 37 wherein the acid anions selected from the group consisting of chloride, sulfate, fluoborate, acetate, sulfamate and mixtures thereof are present in molar proportions at least equal to the combined zinc, nickel and ammonium ions present in said solution.

40. The bath of claim 39 wherein said nonionic, polyoxyalkylated surfactant is selected from the group consisting of alkoxylated alkyl phenols, alkoxylated alkyl naphthols, alkoxylated aliphatic monohydric alcohols, alkoxylated polyoxypropylene glycols, alkoxylated 2,4,7,9-tetramethyl-5-decyne-4,7-diol, alkoxylated ethylene diamine, alkoxylated fatty acids, alkoxylated amides and alkoxylated esters.

41. The bath of claim 40 wherein said nonionic surfactant comprises a polyethoxylated alkyl phenol.

42. The bath of claim 40 wherein said bath is maintained at a pH in the range of from about 3.0 to about 7.0.

43. The bath of claim 42 wherein said zinc ion is present in an amount ranging from about 3.0 to about 75.0 grams per liter of solution.

44. The bath of claim 43 wherein said nickel ion is present in an amount ranging from about 3.0 to about 75.0 grams per liter of solution.

45. The bath of claim 44 wherein said ammonium ion is present in an amount ranging from about 3.0 to about 100 grams per liter of solution.

46. The bath of claim 45 wherein said acid anions are present in a molar amount at least equal to the combined molar amount of nickel, zinc and ammonium ions, the sum total of said acid anions being present in said solution in the range of from about 15.0 to about 200 grams per liter.

47. The bath of claim 46 wherein said nonionic surfactant is present in an amount ranging from about 0.5 to about 20.0 grams per liter of solution.

48. The bath of claim 47 wherein said zinc ion is present in an amount ranging from about 6.0 to about 30.0 grams per liter of solution.

49. The bath of claim 48 wherein said nickel ion is present in an amount ranging from about 3.0 to about 30.0 grams per liter of solution.

50. The bath of claim 49 wherein said ammonium ion is present in an amount ranging from about 50 to about 90 grams per liter of solution.

51. The bath of claim 50 wherein said acid anions are present in said solution in an amount ranging from about 120 to about 200 grams per liter of solution.

52. The bath of claim 51 wherein said nonionic surfactant is present in an amount ranging from about 1.0 to about 5.0 grams per liter of solution.

53. The bath of claim 52 wherein the weight ratio of nickel ion to zinc ion in said solution is from about 1.7 to 1 to about 2.3 to 1.

54. The bath of claim 42 wherein said pH is maintained in the range of from about 5.5 to about 6.5.

55. The bath of claim 40 wherein said bath further contains boric acid in an amount ranging from about 1.0 grams per liter of solution to saturation in said solution.

56. The bath of claim 40 wherein said bath further contains an anionic surfactant in an amount ranging from about 0.2 to about 7.5 grams per liter of solution.

57. The bath of claim 56 wherein said anionic surfactant comprises an alcohol sulfate, an alkyl aryl sulfonate, or mixtures thereof.

58. The bath of claim 56 wherein said anionic surfactant is present in an amount ranging from about 0.4 to about 2.0 grams per liter of solution.

59. The bath of claim 40 wherein said bath further contains a brightener in an amount ranging from about 0.02 to about 2.0 grams per liter of solution.

60. An aqueous composition for the electrodeposition of zinc-nickel alloys which comprises at least 10 g/l zinc, at leat 15 g/l nickel, at least 20 g/l ammonium ions, and a nonionic polyoxyalkylated surfactant in an amount of 0.5 to 20 g/l, which bath has a weight ratio of nickel/zinc of at least 0.5 and a pH of from about 3.0 to about 7.0.

61. An aqueous composition for the electrodeposition of zinc-nickel alloy which comprises at least 10 g/l zinc, nickel, at least 20 g/l ammonium, and at least 0.5 g/l of an nonionic polyoxyalkylated surfactant, which bath has a weight ratio of nickel/zinc of at least 0.5 and a PH of from 3.0 to about 7.0.

* * * * *

UNITED STATES PATENT AND TRADEMARK OFFICE

CERTIFICATE OF CORRECTION

PATENT NO. : 4,765,871

DATED : August 23, 1988

INVENTOR(S) : Grace F. Hsu et al.

It is certified that error appears in the above-identified patent and that said Letters Patent is hereby corrected as shown below:

| | |
|---|---|
| Column 2, line 14: | After "salt," insert --and-- |
| Column 2, line 21: | "zine" should be --zinc-- |
| Column 5, line 3: | Delete the comma "," after corrosion-resistant |
| Column 10, line 18: | "cross-section" should be --cross section-- |
| Column 11, line 40: | "200-hours" should be --200-hour-- |
| Column 12, line 4: | "soltuion" should be --solution-- |
| Column 12, line 12: | "solutin" should be --solution-- |
| Column 12, line 21: | After "after" insert --the-- |
| Column 12, line 24: | Insert a comma "," after coverage |
| Column 12, line 24: | Delete "and" before pitting |
| Column 15, line 51: | After "chloride," insert --fluoborate-- |
| Column 16, line 59: | "leat" should be --least-- |

UNITED STATES PATENT AND TRADEMARK OFFICE

CERTIFICATE OF CORRECTION

PATENT NO. : 4,765,871

DATED : August 23, 1988

INVENTOR(S) : Grace F. Hsu et al.

It is certified that error appears in the above-identified patent and that said Letters Patent is hereby corrected as shown below:

Column 16, line 67: "an" should be --a--

Column 16, line 68: "PH" should be --pH--

Signed and Sealed this

Seventh Day of February, 1989

*Attest:*

DONALD J. QUIGG

*Attesting Officer*

*Commissioner of Patents and Trademarks*